US006484642B1

(12) United States Patent
Kuhns et al.

(10) Patent No.: US 6,484,642 B1
(45) Date of Patent: Nov. 26, 2002

(54) FRAGMENTATION WARHEAD

(75) Inventors: Lucia D. Kuhns, Fredericksburg, VA (US); Donna R. Reedal, Colonial Beach, VA (US); Leonard T. Wilson, Spotsylvania, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 33 days.

(21) Appl. No.: 09/706,134

(22) Filed: Nov. 2, 2000

(51) Int. Cl.[7] ..... F42B 12/22
(52) U.S. Cl. ..... 102/493; 102/497; 102/506
(58) Field of Search ..... 102/493, 497, 102/491, 506

(56) References Cited

U.S. PATENT DOCUMENTS

| | | | | | |
|---|---|---|---|---|---|
| 1,303,727 | A | * | 5/1919 | Rice | 102/493 |
| 2,411,862 | A | * | 12/1946 | Arnold | 102/493 |
| 3,791,818 | A | * | 2/1974 | Watmough et al. | 102/491 |
| 3,880,081 | A | * | 4/1975 | Riffin et al. | 102/491 |
| 4,068,590 | A | * | 1/1978 | Pearson | 102/493 |
| 4,312,274 | A | * | 1/1982 | Zernow | 102/493 |
| 4,495,869 | A | * | 1/1985 | Bisping | 102/493 |
| 4,503,776 | A | | 3/1985 | Nussbaum et al. | 102/496 |
| 4,664,035 | A | | 5/1987 | Osofsky | 102/493 |
| 5,040,464 | A | * | 8/1991 | Pearson | 102/493 |
| 5,087,415 | A | | 2/1992 | Hemphill et al. | 420/95 |
| 5,157,225 | A | | 10/1992 | Adams et al. | 102/493 |
| 5,887,882 | A | | 3/1999 | Atchison | 280/288.1 |
| 5,939,664 | A | * | 8/1999 | Kapoor | 102/307 |
| 5,962,941 | A | | 10/1999 | Serdar, Jr. et al. | 310/153 |

* cited by examiner

*Primary Examiner*—Michael J. Carone
*Assistant Examiner*—M Thomson
(74) *Attorney, Agent, or Firm*—James B. Bechtel, Esq.; Peter J. Van Bergen, Esq.

(57) ABSTRACT

Fragmentation body for fragmentation projectiles and warheads, including an integral fragmentation shell structure made of cast metal, and the shell structure has an outer wall surface and an inner wall surface separated by a thickness of the shell, where at least one of the inner or outer surfaces includes recesses formed through part of the thickness of the shell to define a plurality of fragments which remain integrated with the shell structure until an explosive force is detonated in proximity of the shell, wherein the shell material comprises a steel alloy including carbon, chromium, nickel, molybdenum, cobalt, and the balance essentially being iron. Shell structures of the inventive fragmentation body also have a fragmentation pattern defined via recesses or grooves provided in at least one of the inner or outer wall surfaces thereof to define the size and shapes of the fragment projectiles desired. The steel alloy used is high strength, yet controllably fragmentable into desired and uniform individual projectile shapes and sizes, and in a desired overall dispersion pattern, during case break up.

18 Claims, 2 Drawing Sheets

FRAGMENTATION WARHEAD

STATEMENT OF GOVERNMENT INTEREST

The invention described herein may be manufactured and used by or for the Government of the United States of America for Governmental purposes without the payment of any royalties thereon or therefor.

BACKGROUND OF THE INVENTION

1. Field of the Invention

This invention relates generally to a fragmentation warhead of unique construction.

2. Description of Related Art

To avoid random distribution of fragments propelled by exploding anti-property and anti-personnel devices, it is necessary to control the size, shape, and weight of the fragments. Conventional warheads have included designs where separate munitions are positioned in a canister which, in turn, is contained within the missile structure. Preformed projectiles are positioned over the warhead and held in place by the exterior structure or shroud of the missile. However, in that prior scheme, the exterior structure of the missile tends to interfere with and disrupt the projectile pattern upon detonation of the missile, reducing the effectiveness of the missile warhead.

To address this problem, warheads have been designed in which the warhead casing becomes an integral part of the missile skin and structure. To accomplish this, accommodation of structural strength and fragmentation control must be provided. One prior approach to inducing fragmentation control to an integral warhead and missile structure has been to include grooves on either the external or internal wall surfaces of the structure to delineate fragments or projectiles in a combined warhead and missile structure. Explosives are installed in proximity to the grooves. When the explosives are detonated, the grooves create stress concentrations that cause the structure to fracture along the grooves, forming fragments. Generally, these grooves are longitudinal, circumferential, or both, designed to form rectangular fragments, or constitute a series of intersecting helical grooves designed to produced diamond shaped fragments.

For instance, U.S. Pat. No. 4,664,035 to Osofsky discloses a warhead in which the warhead projectiles are integrated into a missile structure. The integrated missile structure and warhead projectiles are fabricated by precision casting. The outer portion of the structure may be formed of a superalloy, such as nickel-based MAR-M200 (60% Ni), to resist heat. U.S. Pat. No. 4,503,776 to Nussbaum et al. discloses a fragmentation body for fragmentation projectiles and warheads in which prefabricated fragments are molded into a tubular fragmentation shell constituted of metal, or other suitable castable materials.

Despite these prior efforts, room for further improvement still has remained in the design of warhead structures desired to have both structural viability and fragmentation control upon detonation of the warhead, with the recognition that these dual objectives are often at odds with each other.

SUMMARY OF THE INVENTION

The above and other objects are achieved in accordance with the present invention directed to a fragmentation body for fragmentation projectiles and warheads, including an integral fragmentation shell structure having an outer wall surface and an inner wall surface separated by a thickness of the shell, where at least one of the inner or outer surfaces includes recesses formed through part of the thickness of the shell to define a plurality of fragments which remain integrated with the shell structure until an explosive force is detonated in proximity of the shell, wherein the shell material comprises a steel alloy including carbon, chromium, nickel, molybdenum, cobalt, and the balance essentially being iron. Shell structures of the inventive fragmentation body also have a fragmentation pattern defined via recesses or grooves provided in at least one of the inner or outer wall surfaces thereof to define the size and shapes of the fragment projectiles desired.

An important aspect of the invention is the use of an ultrahigh strength steel alloy of a specified composition as an integral controlled fragmentation body or warhead as well as to use it as a structural member of a missile. The steel alloy used in this regard is high strength, yet controllably fragmentable into desired and uniform individual projectile shapes and sizes, and in a desired overall dispersion pattern. A steel alloy found to meet both these criteria in the context of a recess-patterned fragmentation body comprises about 10–15 wt % nickel, about 0.75–1.75 wt % molybdenum, about 2–4 wt % chromium, about 0.2–0.35 wt % carbon, about 8–17 wt % cobalt, and the balance is essentially iron.

Shell structures of the inventive fragmentation body, as formed of the aforesaid steel alloy composition possess excellent mechanical properties, such as high tensile strength and fracture toughness, to permit lower overall weight amounts of the metal to be used in providing a structure which withstands the warhead acceleration loads and forces, while, at the same time, the metal structure nonetheless is amenable to groove/recess patterning therein yielding highly predictable and controllable fragment sizes and shapes, fragment velocity, and fragment distribution (dispersion) patterns, upon detonation of the warhead or missile incorporating same. Specifically, the aforesaid steel alloy composition permits provision of shear control grids in the shell structure, which cause the missile shroud to break into very small, uniformly sized fragments upon detonation of explosive charges carried by the warhead. The fact that the steel alloy used in the inventive fragmentation bodies is very high strength yet also very compliant to controlled fragmentation thereof is considered counter-intuitive and surprising to the present investigators.

Moreover, the aforesaid steel alloy composition is amenable to receiving a fragmentation pattern formed in the shell structure in situ by metal casting procedures. This cast construction averts the cost and timing otherwise associated with machining a fragmentation pattern into an initially continuous wall surface on a shell body. Also, the inventive fragmentation body conveniently can comprise energetic or reactive material positioned in the recesses defining the fragments. For purposes of this application, the terminology "integral", "integrated" and the like, refer to a unitary, single-piece construction.

BRIEF DESCRIPTION OF THE DRAWINGS

These and other features, aspects, and advantages of the present invention will become better understood with regard to the following description, appended claims, and accompanying drawings where:

DETAILED DESCRIPTION OF THE PREFERRED EMBODIMENT(S)

Figure 1:
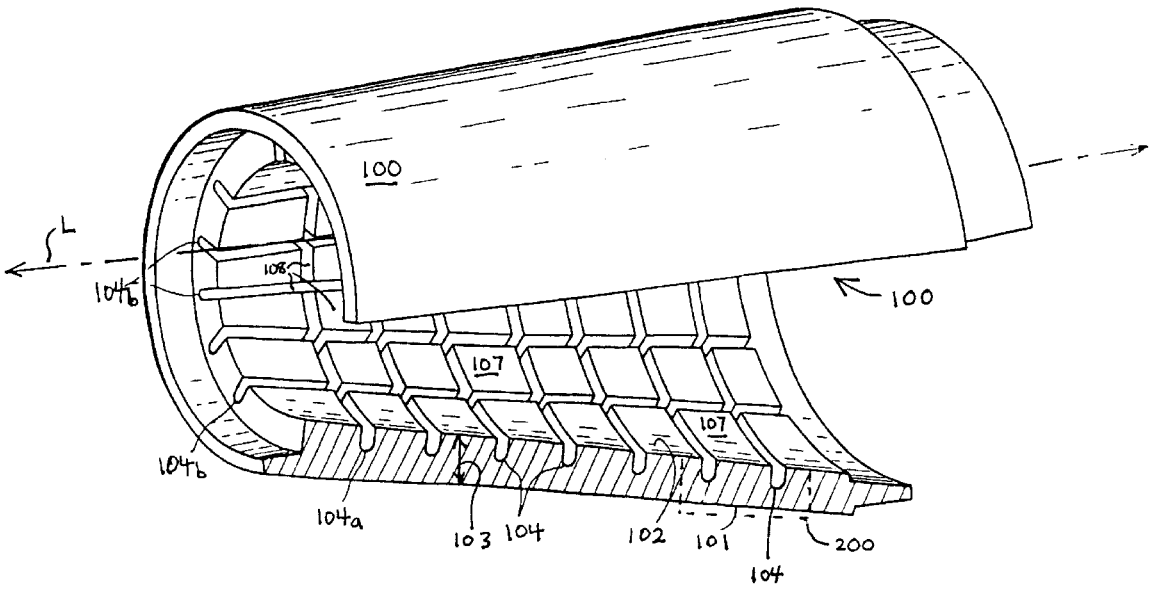
FIG. 1 is a perspective view of a fragmentation warhead of the invention.

Referring now to the figures, and FIG. 1 in particular, a fragmenting section of a warhead or structural member of a missile body, designated as component 100, and hereafter referred to as "warhead 100" for convenience and shorthand, is shown as having an outer wall surface 101 and an inner wall surface 102, and a waffle grid-like structure 108 formed in the inner surface 102. The grid structure 108 is comprised of land areas 107 corresponding to the fragments desired upon detonation of the warhead defined and delineated by intersecting recesses or grooves 104, of which grooves 104*b* extend longitudinally (parallel) to the longitudinal axis "L" of the warhead 100 while grooves 104*a* extend circumferentially relative to the longitudinal axis "L". The warhead 100 has a solid thickness 103 extending radially relative to the longitudinal axis "L". In an optional embodiment, grooves 104*b* may be omitted and the shell is permitted to fragment naturally in the circumferential direction.

The shell-like structure of the warhead 100 has a truncated conical shape in FIG. 1, although other shapes could be employed, such as cylindrical shapes, which are used in airframes of missiles.

Figure 2:
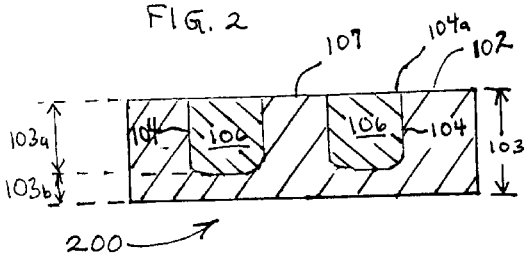
FIG. 2 is an enlarged, partial cross-sectional view of the selected area 200 identified with hatched lines in FIG. 1.

As shown in more detail in FIG. 2, the grooves 104 extend partially, but not completely, through the thickness 103 of the warhead body portion 200. The depth 103*a* of each groove 104 is selected to leave enough of a continuous "skin" thickness portion 103*b* such that the warhead 100 has sufficient structural strength to hold together as a unitary, integral part until explosives are detonated in the warhead when it reaches its target. While the warhead 100 of the invention has been illustrated with the inner wall surfaces including the recesses formed through part of the thickness of said shell to define the plurality of fragments 107 which remain integrated with said shell structure until an explosive force is detonated in proximity of the shell, it will be appreciated that the pattern of recesses alternatively could be provided on the exterior side 101 of the warhead, or on both sides 101 and 102. The gridwork pattern of recesses 104 can be designed to optimize the shape and the velocity of the resulting projectiles upon detonation and/or impact of the warhead 100. For instance, while square-shaped land areas 107 are illustrated in FIG. 1, the land areas 107 also could be diamond-shaped, hexagon-shaped, rectangular-shaped, and so forth. Again, the missile's mission (e.g., surface-to-air interceptor, air-to-air interceptor, fixed land target, mobile land or sea vehicle, anti-personnel, and so forth) can and will influence the selection among these parameters.

As also shown in FIG. 2, one or more type(s) of payload materials 106 are conveniently positioned in or filled into the recesses of said defined fragments 107. The payload materials 106 typically will include energetic or reactive material, either alone in the recesses 104, or in combination with incendiary compounds (e.g., thermite), detonators, luminescent compounds, and/or fogging materials, as provided in other locations of the grid of recesses 104. Although not required, it is ordinarily preferable to dispose the charges 106 flush with the surrounding surfaces of the inner wall surface 102 at the mouths 104*a* of the grooves 104. Optionally, a thin metal, plastic, or ceramic liner (not shown) can be coated, adhered, or mechanically fastened over the charges 106 to aid their retention in the grooves 104. Additionally, while the grooves 104 have been illustrated as annular-shaped having rounded corners at their inner bases, it will be appreciated that the recesses can be formed in any shape that is conducive to controlled fragmentation, such as v-shaped or sawtooth-shaped in addition to the annular-shapes. In another embodiment, the warhead 100 could have all or substantially all the inner space defined by the inner wall surface 102 filled with explosive charges, and not merely the grooves 104.

Also, the grid grooves 104 made in the shell surface(s) can be made with substantially equal depth 103*a*, or, alternatively, it possible to vary the groove depth 103*a* as between the longitudinal grooves 104*b* and the circumferential grooves 104*a*. For instance, and referring again to FIG. 1, where strain is greatest in the circumferential direction of a warhead 100 due to its design, and thus fracture of the longitudinal grooves 104*b* will occur more readily than along the circumferential grooves 104*a*, then the circumferential grooves 104*a* can be made relatively deeper than the longitudinal grooves 104*b* sufficient to provide fragment separation in both directions at a similar time after detonation of the warhead explosives. Alternatively, the longitudinal grooves may be omitted.

While a warhead body 100 of this invention has been illustrated and described herein in detail, it will be appreciated that other necessary parts of a missile that incorporates the inventive integrated warhead 100 as at least part of its airframe, such as a rocket motor, guidance control systems, avionic controls and mechanisms, do not per se form part of the invention but they would be present in the operable missile from a practical standpoint and they could be implemented in manners that one of skill in missile design would be familiar with.

Figure 3:
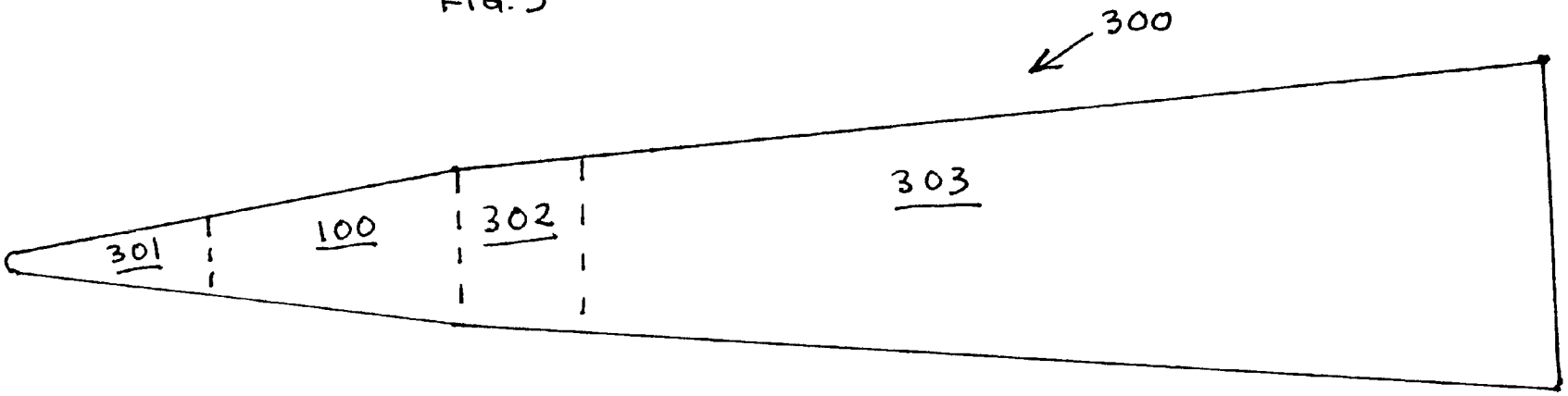
FIG. 3 is a side schematical view of a missile incorporating the integrated warhead 100 of FIG. 1.

For example, FIG. 3 shows one non-limiting illustration of a missile 300 which incorporates the integrated warhead 100, as described herein, with its location in the missile 300 indicated by the imaginary hatched lines at its front and back ends. The missile 300 also includes, for instance, a seeker and fuze section 301; flight and avionic controls, battery and guidance systems section 302; and a motor section 303, and any of sections 301, 302 and/or 303 can be based upon conventional or otherwise suitable systems therefor.

As a fragmenting section of a warhead and structural member of a missile body warhead 100 of this invention, it is integrally formed from a multi-functional steel alloy composition. The steel alloy used in the inventive fragmentation body has high strength, yet is controllably fragmentable into desired and uniform individual projectile shapes and sizes, and in a desired overall dispersion pattern, when explosives are detonated in the warhead 100. A steel alloy found to meet both these criteria in the context of a recess-patterned fragmentation body comprises about 10–15 wt % nickel, about 0.75–1.75 wt % molybdenum, about 2–4 wt % chromium, about 0.2–0.35 wt % carbon, about 8–17 wt % cobalt, and the balance is essentially iron. The high strength alloy steels desired for use in this invention may include other unlisted elements (e.g., Ti, Al, S, Si, Ce, La, etc.), in trace amounts as long as the desired structural and controlled fragmentability attributes in the warhead are not adversely affected. The steel alloys of the above composition are austentized and age hardened steels, such as in manners described in U.S. Pat. No. 5,087,415, which teachings are incorporated herein by reference. Also, the steel alloys of this composition can be melted (such as from ingots), in order to practice the warhead casting operations described herein, by techniques described in U.S. Pat. No. 5,087,415, which teachings are incorporated herein by reference. A commercially available martensitic steel alloy meeting these requirements is Aermet® 100, manufactured by Carpenter Steel Division, Reading Pa.

As indicated above, the warhead (fragmentation shell 100) preferably comprises a metal cast into the desired configuration bearing the fragmentable grid structure 108 (FIG. 1). Aermet® 100 in particular permits casting of shear control grids 108, which cause the missile shroud to break into very small uniformly sized fragments. Techniques for casting the steel metal into the warhead 100 shape desired and including the grid pattern 108, can employ generally known metal casting methods and equipment used therefor, such as those described and referenced in U.S. Pat. No. 4,664,035, which teachings are incorporated herein by reference. In order to reduce cost and time otherwise demanded for machining a controlled fragmentation warhead pattern in a structure, it is convenient to cast this material into the general shape desired including the fragmentation pattern. This is accomplished without sacrificing the high probability of target(s) destruction that is obtained using controlled fragmentation. It also is considered an option for packaging reactive materials. Casting also lends itself to creating large regions in the warhead fragmenting section 100 that can be filled with other anti-property and/or anti-personnel mechanisms such as reactive materials. The ultra high strength of Aermet® 100 also lends itself to being used as a member of the missile structure. The cast fragmentable parts made according to this invention can be retrofitted upon existing missiles or deployed in a new application.

Penetration studies conducted have shown that the ultra-high strength alloy materials described herein can be shaped into viable structural members of a missile airframe while concomitantly fulfilling the role as a controlled fragmenting section of a warhead. Moreover, explosive tests conducted on a cylinder formed of Aermet® 100 demonstrated velocity and fragment mass distribution performance consistent with the predicted outcome.

While the invention has been shown and described with reference to certain preferred embodiments, it will be understood by those skilled in the art that changes in form and detail may be made without departing from the spirit and scope of the appended claims.

What is claimed is:

1. Fragmentation body for fragmentation projectiles and warheads, including an integral fragmentation shell structure comprising cast metal, wherein said shell structure has an outer wall surface and an inner wall surface separated by a thickness of said shell structure, and where at least one of said inner or outer wall surfaces includes recesses formed through part of the thickness of said shell structure to define a plurality of fragments, where said recesses are cast into said shell structure, and said fragments remain integrated with said shell structure until an explosive force is detonated in proximity of said shell structure, and wherein said shell structure comprises a steel alloy having about 10–15 wt % nickel, about 0.75–1.75 wt % molybdenum, about 2–4 wt % chromium, about 0.2–0.35 wt % carbon, about 8–17 wt % cobalt, and the balance is essentially iron.

2. Fragmentation body as claimed in claim 1, further comprising explosive material positioned in at least said recesses for causing failure of said shell structure at said recesses upon detonation of said explosive material.

3. Fragmentation body as claimed in claim 1, further comprising one or more type(s) of payload materials positioned in the recesses of said defined fragments where said payload materials are selected from the group consisting of explosive charges, reactive materials, incendiary compounds, detonators, luminescent compounds, and fogging materials.

4. Fragmentation body as claimed in claim 1, wherein the shell structure has a cylindrical shape.

5. Fragmentation body as claimed in claim 1, wherein the shell structure has a truncated conical shape.

6. Fragmentation body as claimed in claim 1, wherein the shell structure has a shape selected from the group consisting of a curved ogival shape and a truncated ogival shape.

7. Fragmentation body as claimed in claim 1, wherein the shell structure has a shape selected from the group consisting of a spherical shape and substantially spherical shape.

8. Fragmentation body as claimed in claim 1, wherein the shell structure has a longitudinal axis, and said recesses having an orientation selected from at least one of longitudinal, circumferential, and helical, relative to the longitudinal axis.

9. Fragmentation body as claimed in claim 1, wherein said recesses form an intersecting grid pattern.

10. Fragmentation body as claimed in claim 1, wherein said recesses have substantially equal depth relative to each other.

11. Fragmentation body as claimed in claim 1, wherein the shell structure has a longitudinal axis, and said recesses having an orientation selected from at least one of circumferential and helical, relative to the longitudinal axis.

12. Missile body including a fragmentation shell structure comprising cast metal, wherein said shell structure has an outer surface and an inner surface separated by a thickness of said shell structure, and where at least one of said inner or outer surfaces includes recesses formed through part of the thickness of said shell structure to define a plurality of fragments, where said recesses are cast into said shell structure and are filled with an explosive material, and said fragments are integral with said shell structure until said explosive material is detonated wherein said shell structure fails along said recesses as a result of said detonation, and wherein said shell structure comprises a steel alloy having about 10–15 wt % nickel, about 0.75–1.75 wt % molybdenum, about 2–4 wt % chromium, about 0.2–0.35 wt % carbon, about 8–17 wt % cobalt, and the balance is essentially iron.

13. Missile body according to claim 12, further comprising one or more type(s) of payload materials positioned in the recesses of said defined fragments where said payload materials are selected from the group consisting of explosive charges, reactive materials, incendiary compounds, detonators, luminescent compounds, and fogging materials.

14. Missile body according to claim 12, wherein the shell structure has a shape selected from the group consisting of a cylindrical shape, a truncated conical shape, a curved ogival shape, a truncated ogival shape, a spherical shape, and a substantially spherical.

15. Missile body according to claim 12, wherein the shell structure has a longitudinal axis, and said recesses having an orientation selected from at least one of longitudinal, circumferential, or helical relative to the longitudinal axis.

16. Missile body according to claim 12, wherein said recesses form an intersecting grid pattern.

17. Missile body according to claim 12, wherein the shell structure has a longitudinal axis, and said recesses having an orientation selected from at least one of circumferential and helical, relative to the longitudinal axis.

18. Missile body according to claim 12, wherein said shell structure has a truncated conical shape.

* * * * *